US007377360B1

(12) United States Patent
Misiak et al.

(10) Patent No.: US 7,377,360 B1
(45) Date of Patent: May 27, 2008

(54) LADDER STANDOFF DEVICE

(76) Inventors: Steven Misiak, 2745 W. Woodlands Dr., Traverse City, MI (US) 49684; Kristen Misiak, 2745 W. Woodlands Dr., Traverse City, MI (US) 49684

( * ) Notice: Subject to any disclaimer, the term of this patent is extended or adjusted under 35 U.S.C. 154(b) by 0 days.

(21) Appl. No.: 11/724,799

(22) Filed: Mar. 15, 2007

(51) Int. Cl.
*E06C 7/00* (2006.01)

(52) U.S. Cl. ..... 182/107; 182/214

(58) Field of Classification Search ..... 182/107, 182/214, 108, 111, 200
See application file for complete search history.

(56) References Cited

U.S. PATENT DOCUMENTS

| | | | | |
|---|---|---|---|---|
| 972,001 | A * | 10/1910 | Holdorf | 182/214 |
| 2,196,640 | A * | 4/1940 | Meier | 182/111 |
| 2,327,317 | A * | 8/1943 | Randall | 182/214 |
| 3,288,249 | A | 11/1966 | Gibson | |
| 3,459,277 | A * | 8/1969 | Frederick | 182/214 |
| 4,359,138 | A * | 11/1982 | Kummerlin et al. | 182/214 |
| 4,369,860 | A | 1/1983 | Beane | |
| 5,261,507 | A * | 11/1993 | Williams et al. | 182/214 |
| 5,931,259 | A | 8/1999 | Hoey | |
| 6,394,229 | B1 | 5/2002 | Hastreiter | |
| 6,722,469 | B1 | 4/2004 | Weger, Jr. | |
| 6,851,518 | B1 | 2/2005 | Walker | |

FOREIGN PATENT DOCUMENTS

EP 232206 A2 * 8/1987

* cited by examiner

*Primary Examiner*—Alvin C Chin-Shue
(74) *Attorney, Agent, or Firm*—Robert L. McKellar; McKellar IP Law, PLLC

(57) ABSTRACT

A ladder standoff device comprising in combination an elongated member, at least one standoff arm, at least one support arm, a second adjustable elongated member, at least one ladder rail brace, at least one ladder rail fastener, at least one torsion spring, and at least one non-slip pad, said ladder standoff device being useful for supporting a ladder against a flat side wall or against a slanting roof structure.

4 Claims, 6 Drawing Sheets

LADDER STANDOFF DEVICE

The present invention deals with a ladder stabilizer that also acts as a standoff device. The device is used to protect gutters, roof drip edges, shingle edges, fascia and eaves from the potential damage incurred from a ladder resting against them. At the same time the device is used as a standoff it also acts to stabilize the ladder by way of standoff arms and non-slip surfaces on the pads. The non-slip pads engage whatever surfaces they come into contact with thereby securing the ladder. The instant device is self-leveling and self-adjusting and attaches to a typical extension ladder through a rung.

BACKGROUND OF INVENTION

Ladder stabilizers and standoff devices are not new to the art. However, the instant device allows for more stable, secure access to elevated portions of a home or building due to the four non-slip pads on which all the weight is placed. The device also features self-leveling and self-adjusting standoffs, which attach to any fiberglass or aluminum extension ladder through the hollow rungs of the ladder.

U.S. Pat. No. 4,369,860 issued to Beane on Jan. 25, 1983, describes a device that is a standoff with two non-slip pads. This prior art device is limited in many aspects. The standoff mounts to the top surface of the rungs obstructing safe use of the effected rung. The non-slip pads that are mounted to the standoffs are not adjustable. FIG. 1 of the reference shows the non-slip pads resting within a gutter which limits positioning where a gutter attachment is located. Locating the standoff within the gutter is not safe and if the ladder were to slip it would damage the gutter. This design also does not allow the device to be used against a wall. The standoff is secured by clamps and does not afford the strength and stability of the standoff being mounted through the rung itself. The standoff of Beane cannot be used on a flat roof and is not self leveling or adjustable for the distance between the roof and the ladder. The adjustability and the self-leveling aspects of the instant device make it far more unique and superior to Beane.

U.S. Pat. No. 6,394,229 issued to Hastreiter on May 28, 2002 is taught as a ladder attachment kit. This device fails to provide the adjustability in the same manner as the instant device. It also is limited in that it is only capable of roof access and not capable of use on a wall. The device mounts to the top of the ladder only. The pads are not spring loaded and in the process of placement of the device, the pads may not self-level, raising the potential for the user to attempt to access the roof only to fall when their weight causes the pad to level. The device also only has one pad per side thus not affording the level of stability of the instant device. The instant device allows for the distance between the sets to be adjustable giving it greater support or better weight distribution across the non-slip pads.

U.S. Pat. No. 6,722,469 issued to Weger, Jr. on Apr. 20, 2004 is a guard plate and safety anchor. This device actually is affixed to the roof and not the ladder. This device has many substantial drawbacks when compared to the instant device. The attachment of the ladder security device itself could be dangerous because one does not have a way to secure a ladder for its deployment. Also it claims to secure to the roof between the roof surface and the surfaces covering or between the roof and its shingles. This would damage the roof covering or shingle, substantially limiting the usefulness of the device. The device is portable in the sense that every time one wants to move the ladder one must remove and redeploy the device which is time consuming and potentially very damaging to the roof. Finally the safety bar obstructs the ladder rung making it dangerous.

U.S. Pat. No. 5,931,259 issued to Hoey on Aug. 3, 1999 is a safety ladder attachment. The primary purpose of this device is ladder stabilization and not as a standoff. The instant device accomplishes both a stabilizing and standoff device. The device is limited in that it only attaches to the top of the ladder making it top heavy. Because it does not act as a standoff it can damage the drip edge or gutter easily. The device is only capable of use on a roof. It will not work against a wall. The pad configuration is limited also in that it only provides two pads, one for each side, and the pads are not spring loaded so as to give the self-leveling feature of the instant device.

U.S. Pat. No. 6,851,518 that issued to Walker on Feb. 8, 2005 is a ladder stabilizer. This device is different from the instant device in that its support arms do not pivot or self-level. The instant device has a set of support pads where the Walker device has only one per side that does not allow the device to adjust to uneven surfaces. The lack of more support pads does not allow the Walker device to distribute weight evenly or help to prevent damage to roofs, sidings or angled surfaces. Like many of the other prior art devices, this device attaches to the outside surface of the rungs creating a safety hazard. The device also mounts to the ladder at a ninety-degree angle, which does not allow for safe contact on angled roofs. The lack of pivoting arms and extra pads as well as the mounting through the rungs show a clear difference between the instant invention and the prior art.

U.S. Pat. No. 3,288,249 that issued to Gibson on Jun. 4, 1965 is a gutter bridge ladder attachment. The device has many of the trappings of the other prior art devices. The device attaches inside the ladder rungs raising a safety issue with rung obstruction. The device also has a single pad system limiting the weight distribution and its ability to safely grip a surface. The clamping system is cumbersome and is designed for round rung ladders where current ladders now have multiple shapes, including triangular. The single pad system also does not include a spring load.

DETAILED DESCRIPTION OF THE DRAWINGS

Figure 1:
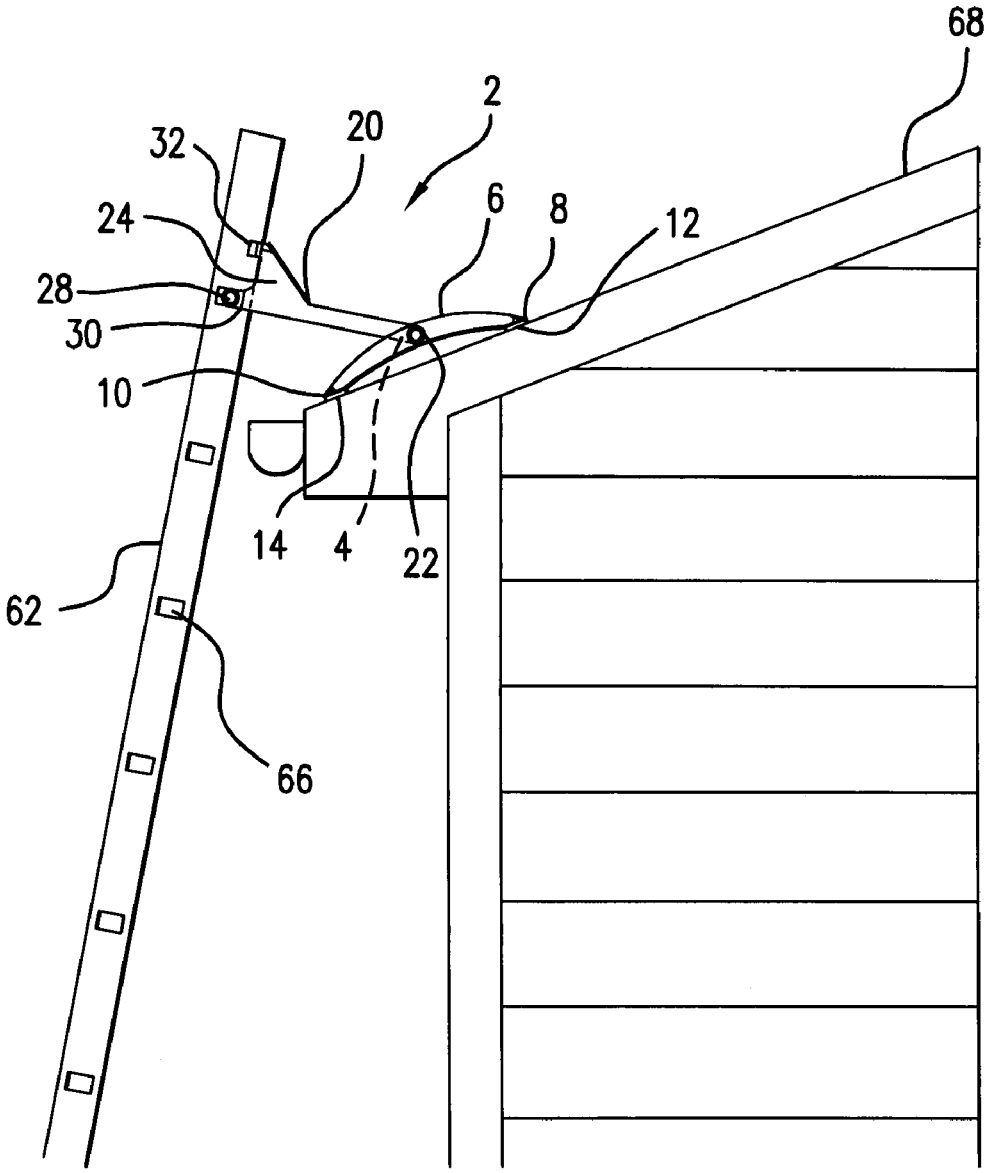
FIG. 1 is a side view of the ladder standoff device used for roof access showing only a portion of the ladder.

FIG. 1 is a side view of the ladder standoff device 2 used for roof access. The standoff 2 is used to access roofs or to perform work in elevated areas while protecting the work area from potential damage that may be caused by traditional methods of elevated work. The standoff 2 attaches to a standard extension ladder 62 through a ladder rung 66. This Figure shows the first side top anti-slip pad 12 and the bottom pad first side standoff pad 14 resting on the roof 68.

These pads 12 and 14 are attached to the first self leveling stand off arm 6. The top pad 12 is attached to the self-leveling stand off arm 6 at the attachment point 8. The bottom pad 14 is attached to the self-leveling stand off arm 6 at the attachment point 10. Not shown in this Figure is the second self-leveling stand off arm 34 which is essentially the same as the first self leveling stand off arm 6. Both arms 6 and 34 are connected by an elongated member 4 that passes through opening 16 of arm 6 and opening 44 of arm 34. The elongated member 4 passes through the first support arm 20 at its near end 22 and the second support arm 48 at its near end 50. The distal end 24 of the support arm 20 connects to the ladder 62 via the ladder rail fastener 32 at the top of the distal end 24 of support arm 20. At the bottom of the distal end 24 is ladder rail brace 30. Not shown is a second support arm 48 that is essentially identical to the first support arm 20. Both the first and second support arms 20 are connected via the adjustable rung elongated member 64 that passes through opening 28 of the first support arm 20 near its distal end 24.

Figure 2:
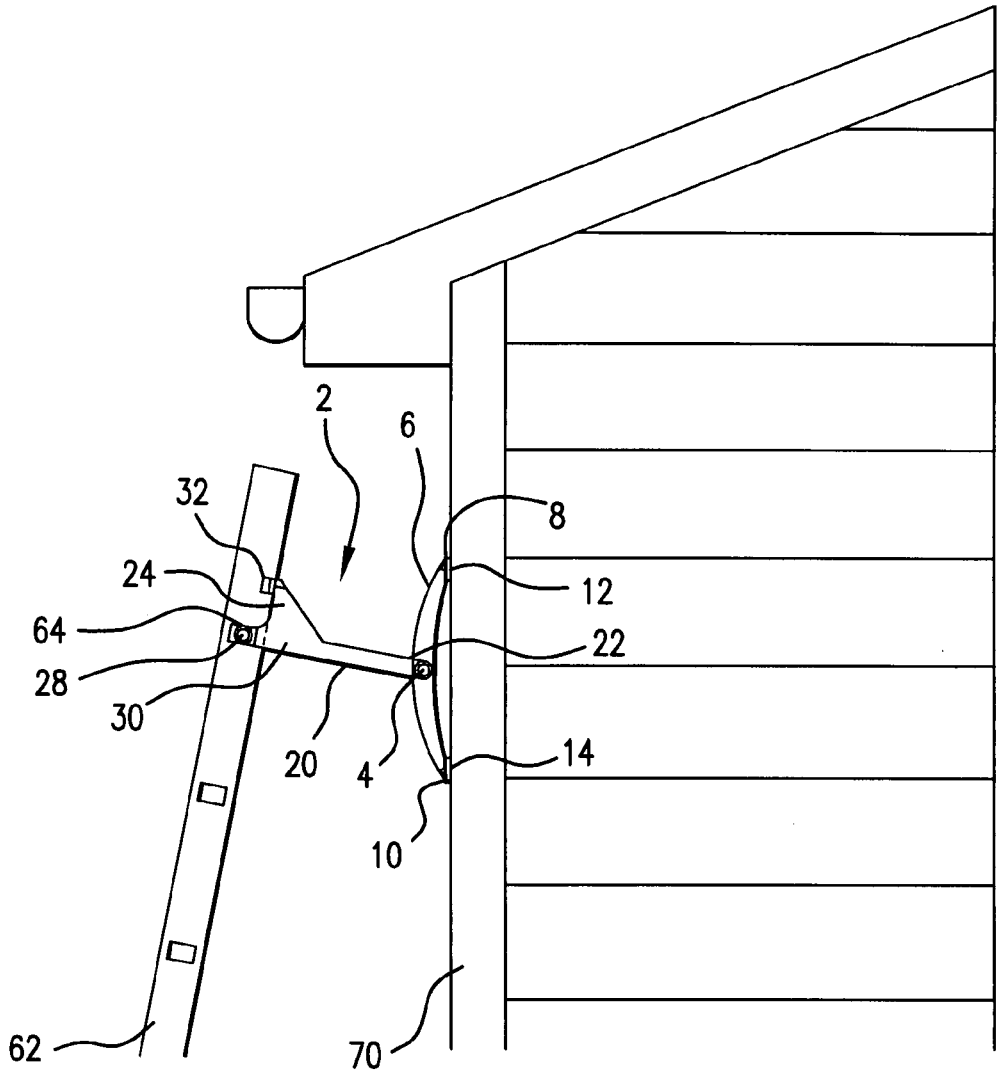
FIG. 2 is a side view of the ladder standoff device placed against a vertical wall showing only a portion of the ladder.

FIG. 2 is a side view of the ladder standoff device 2 placed against a vertical wall. This Figure shows the versatility of the device in use. Instead of being used over the eves, the ladder 62 is stabilized against a vertical wall. Both the top pad 12 and the bottom pad 14 rest against the wall securely via the non-slip construction. These pads are attached at the attachment point 8 for the top pad 12 and attachment point 10 for the bottom pad 14. The self-leveling stand off arm 6 is connected to the support arm 20 via the elongated member 4. The distal end 24 of the support arm 20 is attached to the ladder 62 via the ladder rail fastener 32 and the ladder rail brace 30 via the elongated rung member 64 through opening 28 in the distal end 24 of support arm 20.

Figure 3:
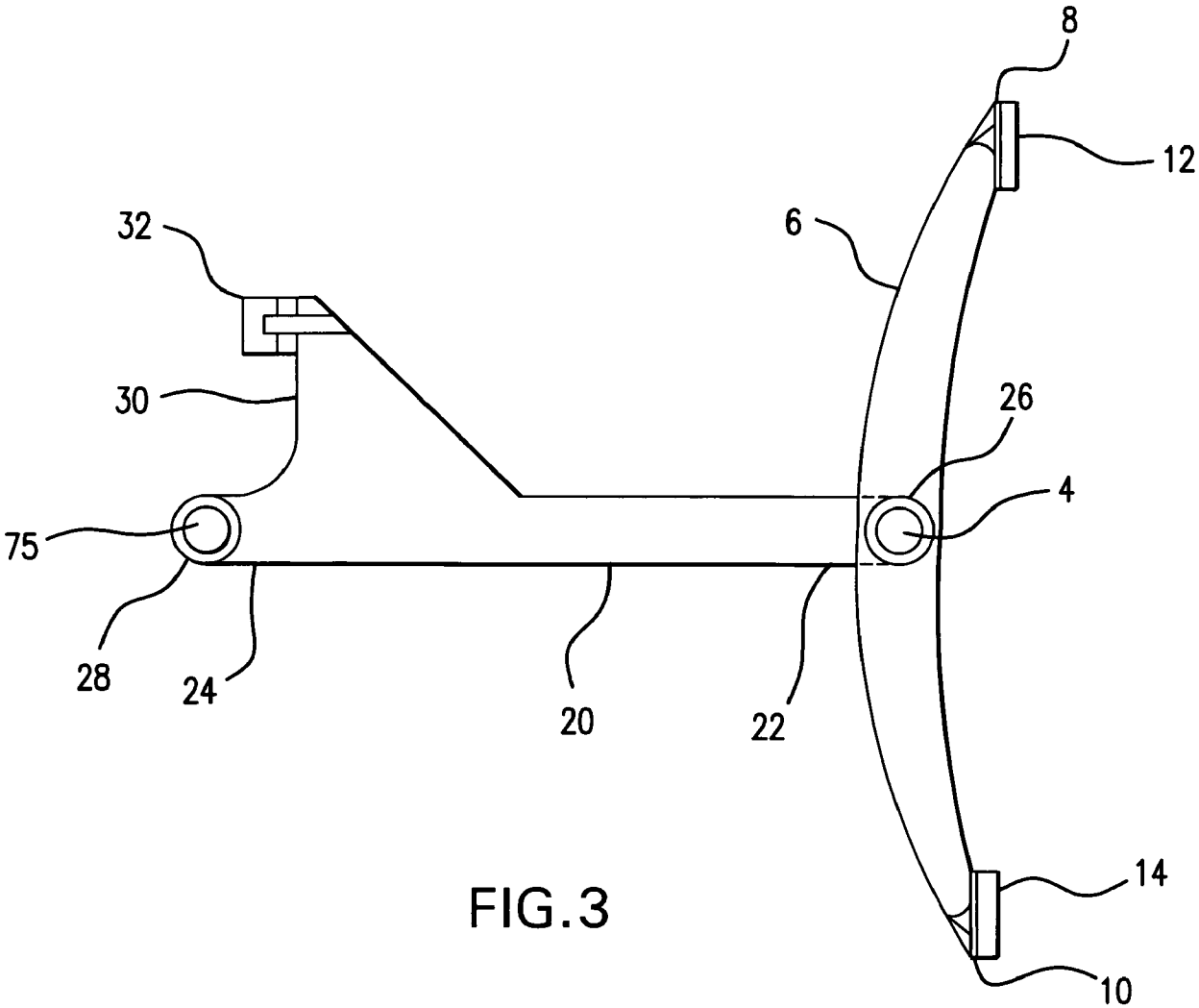
FIG. 3 is an enlarged side view of the support arm, self-leveling arm and pads.

FIG. 3 is an expanded side view of the support arm 20, self-leveling stand off arm 6 and pads 12 and 14. The pads 12 and 14 are attached to the self-leveling stand off arm 6 at their respective attachment points 8 and 10. The self-leveling stand off arm 6 is attached to the elongated member 4 via the opening 26 therethrough the near end 22 of support arm 20. Shown more clearly are the distal end 24 of the support arm 20 which features ladder rail fastener 32 at the top of the distal end 24 of the support arm 20. The bottom of the distal end 24 of support arm 20 also includes an opening 28 therethrough that facilitates the insertion of the rung elongated member 64. This rung elongated member is inserted into a rung of a standard ladder connecting the first support arm 20 to the ladder 62. This feature allows the adjustability other devices do not have and provides attachment that is not obstructing the ladder rungs when the ladder is in use. This feature makes the instant device safer.

Figure 4:
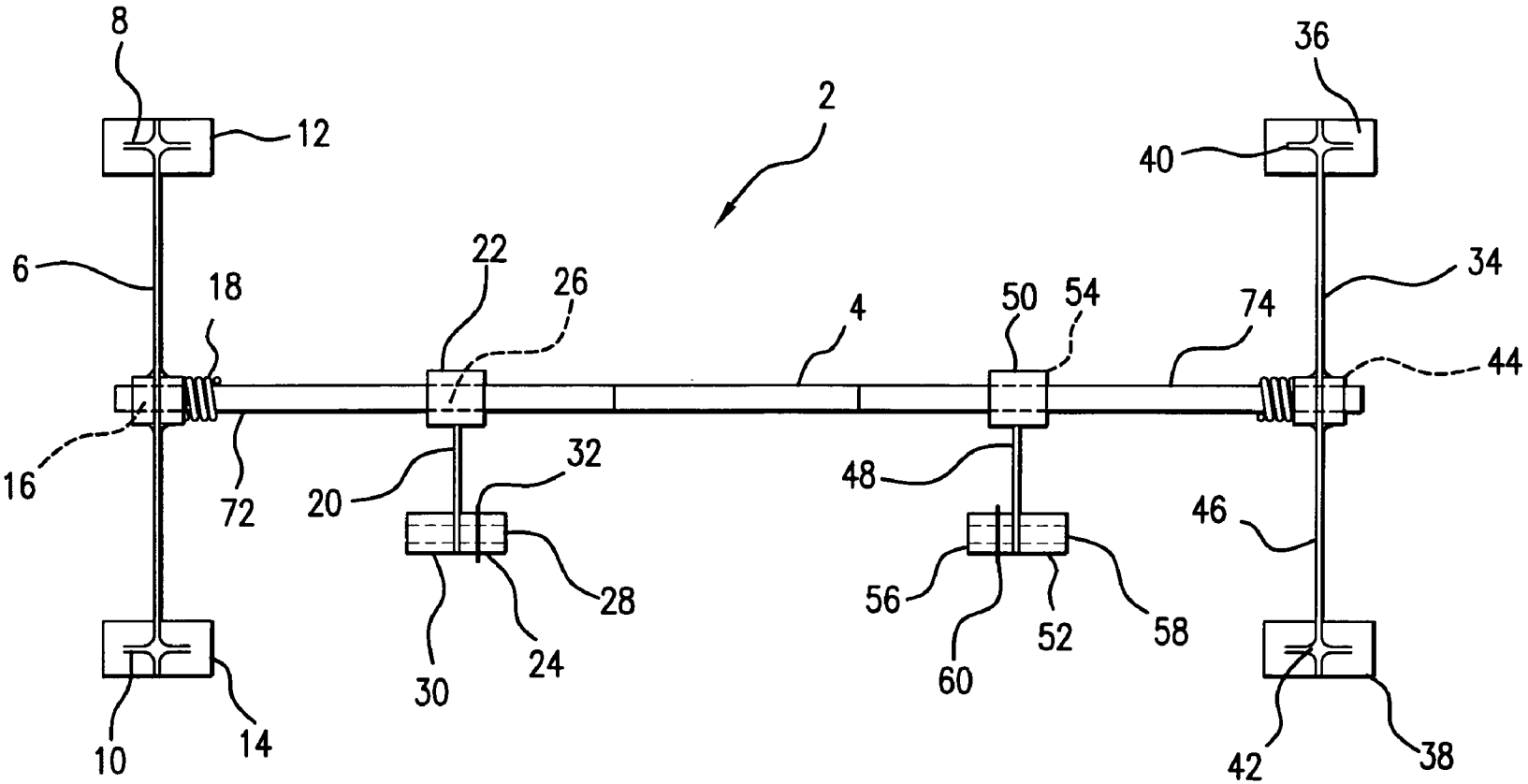
FIG. 4 is a front view of the device not attached to a ladder.

FIG. 4 is a front view of the device not attached to a ladder. This perspective shows the entire ladder stand off device 2 components. The first self-leveling standoff arm 6 is attached to near end 72 the elongated member 4 with the other or second self-leveling standoff arm 34 shown attached to the distal end 74 of the elongated member 4. The first self-leveling standoff arm 6 has a top non-slip pad 12 and a bottom non-slip pad 14. The non-slip pads are attached to the stand off arm 6 via the attachment points 8 and 10 respectively. The standoff arm 6 is attached to the elongated member 4 at the opening therethrough 16. The standoff arm also incorporates a torsion spring 18 wherein it is attached to the elongated member 4. This feature is crucial to the uniqueness of the stabilization of the device 2. The torsion spring 18 keeps the first standoff arm 6 and the second standoff arm 34 in line when the device is not on a surface. The opposite end is essentially identical to the first side. The second self-leveling standoff arm 34 has a top non-slip pad 36 and a bottom non-slip pad 38. The non-slip pads are attached to the stand off arm 34 via the attachment points 40 and 42 respectively. The standoff arm 34 is attached to the elongated member 4 at the opening therethrough 44. The standoff arm also incorporates a torsion spring 46 where it is attached to the elongated member 4. The second standoff arm 34 derives the same benefits from the torsion spring 46 as the first standoff arm does. This Figure also shows the relationship between the stand off arms 6 and 34 with the support arms 20 and 48. The near end 22 of support arm 20 attaches to the elongated member 4 through opening 26. The distal end 24 of the stand off arm 20 attaches to the ladder via the opening 28 therethrough and incorporating the rung elongated member 64 (not shown). The distal end 24 of stand off 20 also features a ladder rail brace 30 supporting 64 and its attachment to 24 the distal end. Also shown at the top of the distal end 24 is the ladder rail fastener 32 that lends support for the attachment of the distal end 24 of the support arm 20 to a standard ladder. The near end 50 of support arm 48 attaches to the elongated member 4 through opening 54. The distal end 52 of the stand off arm 48 attaches to the ladder via the opening 56 and incorporates a rung elongated member 75 (not shown). The distal end 52 of stand off 48 also features a ladder rail brace 58 supporting 75 and its attachment to 52 the distal end. Also shown at the top of the distal end 52 is the ladder rail fastener 60 that lends support for the attachment of the distal end 52 of the support arm 48 to a standard ladder.

Figure 5:
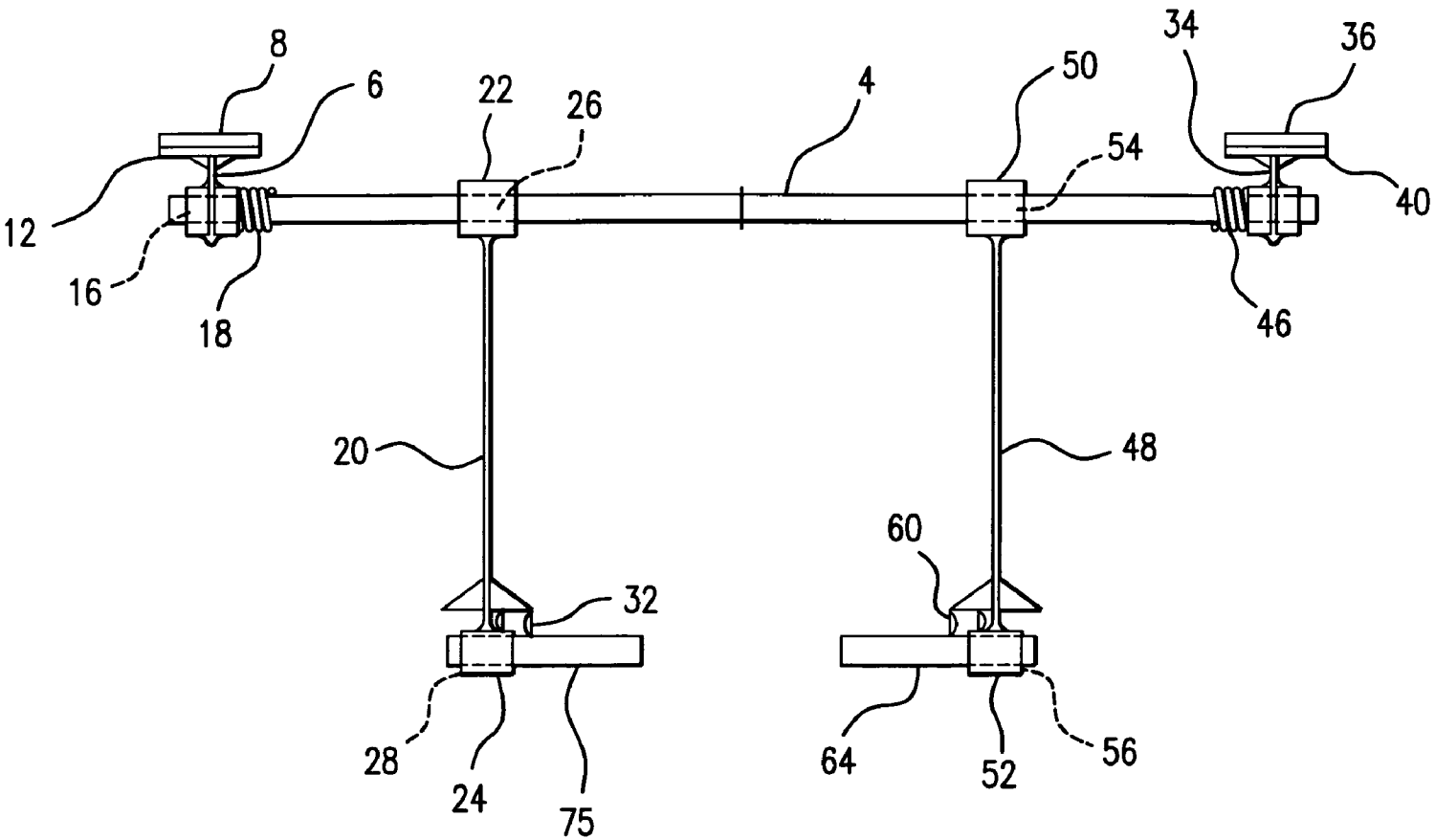
FIG. 5 is a top view of the ladder stand off.

FIG. 5 is a top view of the ladder stand off. This Figure shows the relationship between the rung elongated member 64 and the elongated member 4. The rung elongated members 64 and 75 allow the support arms 20 and 48 to be moved closer together or farther apart, adjusting to different ladder widths, and at the same time they can adjust to that width on the elongated member 4. This feature gives more flexibility to the device than the prior art devices. Also shown are elements that have already been discussed but are reintroduced for clarity. The first self-leveling standoff arm 6 is attached to the elongated member 4 and uses the torsion spring 18 to control the self-leveling aspect of the stand off arm 6. The non-slip pad 12 is shown clearly attached to attachment point 8 of standoff arm 6. The support arm 20 is clearly attached to the elongated member 4 at the near end 22 of the support arm 20 through opening 26. The near end 24 of support arm 20 is attached to the rung elongated member 64 through opening 28. Also shown is the ladder rail fastener 32 that attaches to the side of the ladder for a secure attachment.

The second self-leveling standoff arm 48 is attached to the elongated member 4 and uses the torsion spring 46 to control the self-leveling aspect of the stand off arm 34. The non-slip pad 36 is shown clearly attached to attachment point 40 of standoff arm 34. The support arm 48 is clearly attached to the elongated member 4 at the near end 50 of the support arm 48 through opening 54. The near end 52 of support arm 48 is attached to the rung elongated member 75 through opening 56. Also shown is the ladder rail fastener 60 that will attach to the side of the ladder for a secure attachment.

Figure 6:
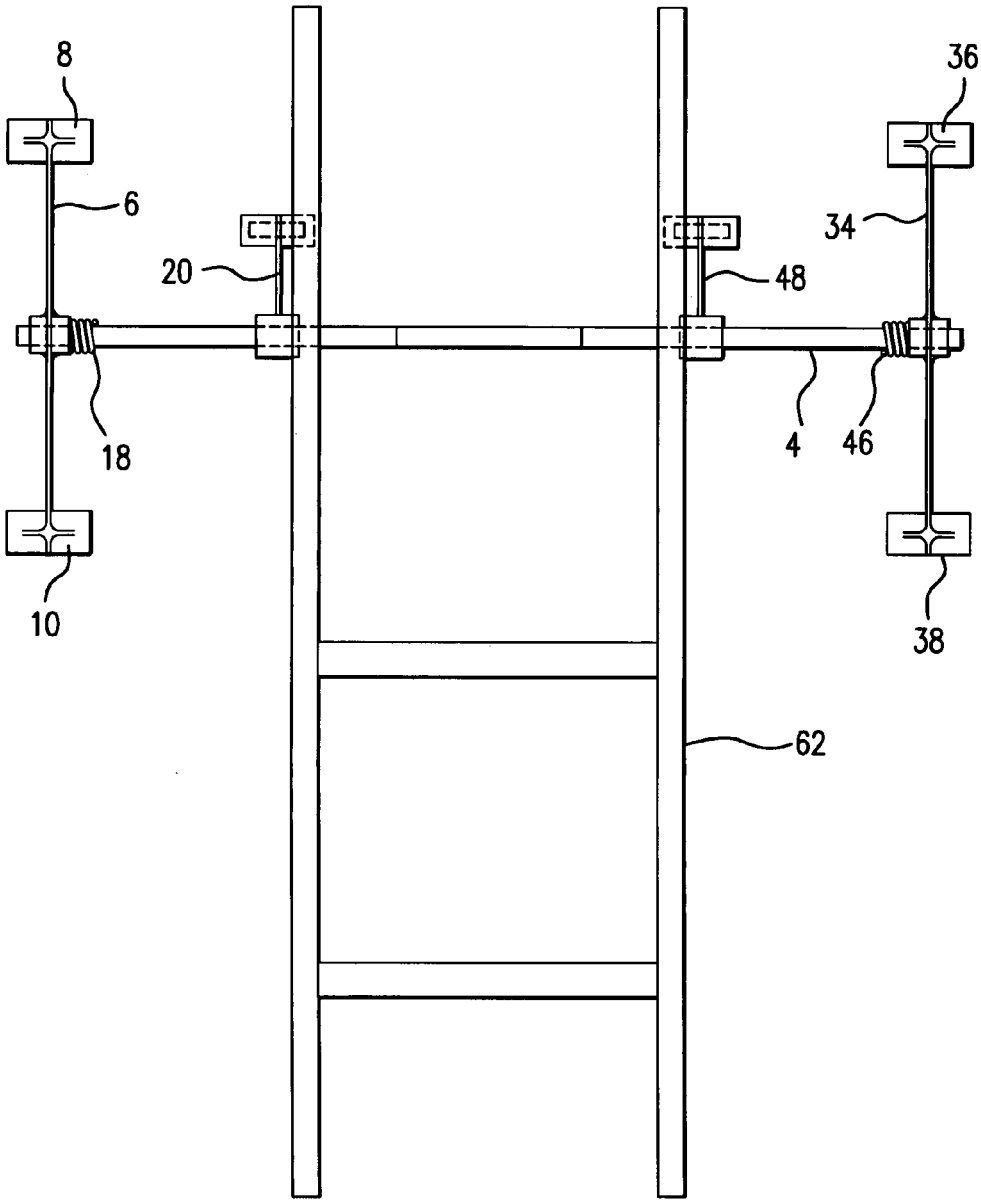
FIG. 6 is a front view of the ladder stand off device attached to a standard ladder with the elongated member 64 shown in phantom with only a portion of the ladder shown.

FIG. 6 is a front view of the ladder stand off device 2 attached to a standard ladder with the rung elongated members 64 and 75 shown in phantom. The non-slip pads 12, 14, 36 and 38 are manufactured, for example, of silicone, and are non-slip. The non-slip pads 12, 14, 36 and 38 could however be manufactured from any suitable material that would be non-slip against wood, metal and shingle surface, and the like. The non-slip pads 12, 14, 36 and 38 are not only non-slip but also provide a range of protection to surfaces that the pads will come into contact with such as aluminum, vinyl, or wood siding. The stand off arms 6 and 34 work independently of each other because of their respective torsion springs 18 and 46. The significance here is that the one set of pads say 12 and 14 could be in contact with a surface at one angle while the second set of pads 36 and 38 are aligned along a different angle in relation to the first stand off arm 20 and pads 12 and 14. When the device 2 is deployed the torsion springs allow the device to align itself according to the specific angle of the surface that it is deployed against. These features give the device unlimited flexibility in comparison to the prior art devices.

What is claimed is:

1. A ladder standoff device comprising in combination;

an elongated member, at least one standoff arm, an adjustable elongated member, at least one support arm having a ladder rail brace and at least one ladder rail fastener, and at least one non-slip pad, said elongated member having a near end and a distal end having a torsion spring mounted thereon and biasing said standoff arm, said standoff arm being of an arcuate shape and having a top end, a bottom end and a mid section, said mid section having an opening therethrough receiving an end of said elongated member; said top end mounting one of said non-slip pad, said bottom end mounting another of said non-slip pad, said support arm having a near end and a distal end, said near end having an opening therethrough receiving said elongated member, said distal end having attached thereto, said ladder rail fastener; an opening therethrough receiving one of said adjustable elongated member.

2. A device as claimed in claim 1 wherein said non-slip pads are manufactured from silicone.

3. A said device as claimed in claim 1 wherein device is manufactured from a group of materials consisting essentially of metal, plastic, wood, ceramic, graphite, and combinations thereof.

4. A device as claimed in claim 3 wherein the metal is aluminum.

* * * * *